US005413121A

United States Patent [19]

Dawson et al.

[11] Patent Number: 5,413,121

[45] Date of Patent: May 9, 1995

[54] CIGARETTE MAKING MACHINE

[75] Inventors: John Dawson, Coventry; Derek H. Dyett; Norman L. Sharp, both of High Wycombe; James R. Stembridge, Coventry, all of England

[73] Assignee: Molins PLC, England

[21] Appl. No.: 111,411

[22] Filed: Aug. 25, 1993

[30] Foreign Application Priority Data

Aug. 26, 1992 [GB] United Kingdom ..... 9218176
Nov. 11, 1992 [GB] United Kingdom ..... 9223611

[51] Int. Cl.[6] ..... A24C 5/18

[52] U.S. Cl. ..... 131/84.1; 131/108; 131/84.2; 131/84.3

[58] Field of Search ..... 131/84.1, 108, 109.1, 131/904, 84.2–84.4

[56] References Cited

U.S. PATENT DOCUMENTS 4,397,320 8/1983 Labbe ..... 131/84.1 X
4,945,927 8/1990 Belvederi ..... 131/904 X
5,141,003 8/1992 Dawson et al. ..... 131/108
5,199,446 4/1993 Cahill et al. ..... 131/84.1

FOREIGN PATENT DOCUMENTS 2221137 1/1990 United Kingdom ..... 131/84.1

*Primary Examiner*—Jennifer Bahr
*Attorney, Agent, or Firm*—Antonelli, Terry, Stout & Kraus

[57] ABSTRACT

In a cigarette making machine, tobacco is arranged to be showered towards two suction bands to form tobacco sub-streams on the respective bands which are then merged to form a single cigarette filler stream which (possibly after trimming) is enclosed in a wrapper web to form a continuous cigarette rod, and the machine includes means for disturbing at least part of the tobacco of at least one of the tobacco sub-streams before the two sub-streams are merged. This disturbance of the sub-streams preferably causes or permits a degree of reorientation of the disturbed tobacco and a degree of interengagement between tobacco particles of the two sub-streams. In one example at least part of this disturbance is caused during the transfer of both sub-streams to a further suction band which carries the merged stream to the wrapper web.

19 Claims, 7 Drawing Sheets

CIGARETTE MAKING MACHINE

This patent application is concerned with a number of improvements/modifications with respect to the cigarette making machine concept described in our U.S. Pat. No. 5,199,446 in which a cigarette filler stream is formed by showering tobacco towards two converging bands to form two tobacco sub-streams which are merged to form a single cigarette filler stream.

Reference is also directed in this context to our U.S. Pat. No. 5,141,003.

According to one aspect of this invention, in a cigarette making machine in which tobacco is arranged to be showered towards two suction bands to form tobacco sub-streams on the respective bands which are then merged to form a single cigarette filler stream which (possibly after trimming) is enclosed in a wrapper web to form a continuous cigarette rod, means are provided for disturbing at least part of the tobacco of at least one of the tobacco sub-streams before the two sub-streams are merged.

The disturbance of the tobacco preferably causes or permits at least a degree of reorientation of the disturbed tobacco, The resulting increase in the randomness of the tobacco orientation can improve the firmness of the final cigarettes. Preferably also (depending upon the nature of the tobacco) the reorientation results in a degree of interengagement (interlocking) between tobacco particles of the two sub-streams, thus miniraising the loss of tobacco from the ends of cigarettes which tends to occur during subsequent handling and packing of the cigarettes.

The merged sub-streams may be received by a further suction band, in which case the disturbance (or part of the disturbance) of the tobacco in both sub-streams preferably occurs as the tobacco transfers from the initial suction bands to the third band. Alternatively, the sub-stream on one of the initial suction bands may be transferred to the second of the bands on which the second sub-stream is formed, and may be disturbed in the course of that transfer. A further possibility is that each of the tobacco sub-streams may be disturbed mechanically, pneumatically or by centrifugal force, or by a combination of two or more of such factors, while being carried by the suction bands on which they were initially formed.

Other aspects of this invention, which may be used in combination with the first aspect or in any other combination, are defined in the appended claims. The examples described with reference to the accompanying drawings illustrate some ways in which various aspects of this invention may be used in combination.

Examples of cigarette making machines embodying various aspects of this invention are shown in the accompanying diagrammatic drawings in which.

Figure 1:
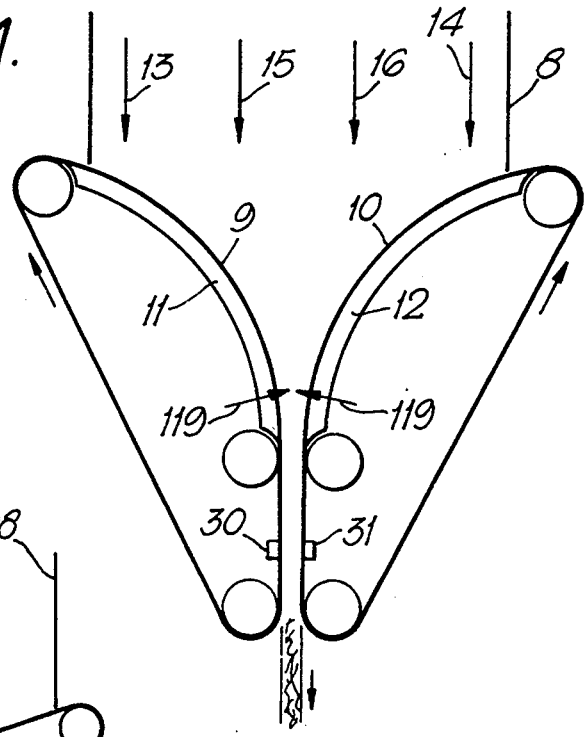
FIG. 1 is a plan view of one machine.

FIG. 1 of the accompanying drawings shows diagrammatically a cigarette making machine in which tobacco is showered substantially horizontally through a shower channel 8 towards converging suction bands 9 and 10. Instead of each of these bands being arranged to move along a linear path in the region where it receives showered tobacco, as described in our earlier patents, it is constrained by a guide member 11 or 12 to move along a curved path presenting a convex surface to the showered tobacco. Thus, where tobacco first arrives on each band, in the regions of the arrows 13 and 14, each band (being almost at right angles to the direction of movement of tobacco) has almost no forward component with respect to the arriving tobacco: i.e., component of movement in the direction of the tobacco movement. On the other hand, tobacco subsequently arriving on the band, for example in the regions of further arrows 15 and 16 lands on portions of the bands which have a significant forward component with respect to the arriving tobacco. This results in the strands of some tobacco (forming outer zones of the merged filler stream) tending to be longitudinally orientated with respect to the cigarette rod, while tobacco in the middle of the cigarette will tend to be more randomly orientated. While the former is beneficial with respect to ends retention, the latter is beneficial with respect to tobacco filling power giving rise to firm cigarettes.

An alternative to the Figure I construction, giving the same effect, would involve two large suction wheels in place of the suction bands 9 and 10.

Figure 2:
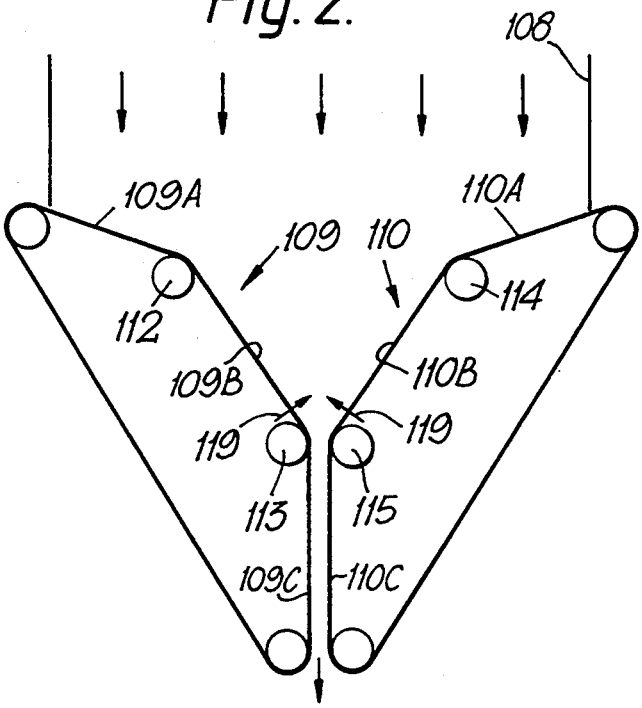
FIG. 2 shows a modification of the machine shown in FIG. 1.

A similar effect may alternatively be achieved by arranging for the path of each band to have two or more linear portions at different angles to the showered tobacco, the transition for each band being achieved by pulleys or by curved fixed guides. FIG. 2 is a diagrammatic illustration of the former example. It shows tobacco being showered substantially horizontally through a shower channel 108 towards bands 109 and 110 passing around pulleys so that each is constrained to move initially along a linear path 109A or 110A which is almost at right angles to the direction of movement of the tobacco (giving only a slight forward component), and subsequently along a linear path 109B or 110B which has a substantial forward component with respect to the showered tobacco. As mentioned above, the pulleys in the active region of the bands (i.e. pulleys 112 to 115) may be replaced by curved guides.

Each of the examples shown in FIGS. 1 and 2 may, if desired, include air outlets for pneumatically separating at least some of the tobacco of the two tobacco sub-streams from the respective bands before the streams merge, so as to reorientate at least some of the tobacco strands and, to some extent, to interengage or mix the tobacco strands of the two sub-streams on the respective bands before the merged tobacco stream begins to be compressed by the substantially parallel-moving portions of the bands (109C and 110C in FIG. 2). Such air flows are illustrated by arrows 119.

FIG. 1 also shows an air pressure chamber 30 from which air is blown through the merged tobacco stream (passing through the bands) into a chamber 31. The pressure drop between the chambers 30 and 31 is measured and gives an indication of the mass/density of the merged tobacco stream. This signal may be used to control tobacco trimmers (not shown) operating on the respective tobacco sub-streams on the bands 11 and 12, or a trimmer acting on the merged tobacco stream, for example as in FIGS. 8–10 or in FIG. 13 or 14 or in FIGS. 15 to 18.

This feature of an air pressure chamber for determining the mass/density of the cigarette filler stream may be used in cigarette making machines which are not in accordance with the present invention. In general terms, we envisage that the conventional nucleonic device for monitoring the mass of the finished cigarette rod may be replaced by a pressure drop measurement device in the region where the cigarette filler stream is set at a predetermined cross section. In order to calibrate the pressure drop measurement (preferably automatically and at regular or random intervals), provision may be made for automatically removing a finished cigarette at regular intervals for automatic weighing, this signal being used to calibrate the on-line measurement device; there may also be provision for returning each weighed cigarette to the cigarette flow stream, for example in the filter attachment machine. In place of pressure drop measurement, use may be made of infra red or other mass/density measurement, again with automatic regular calibration as described above.

Figure 3:
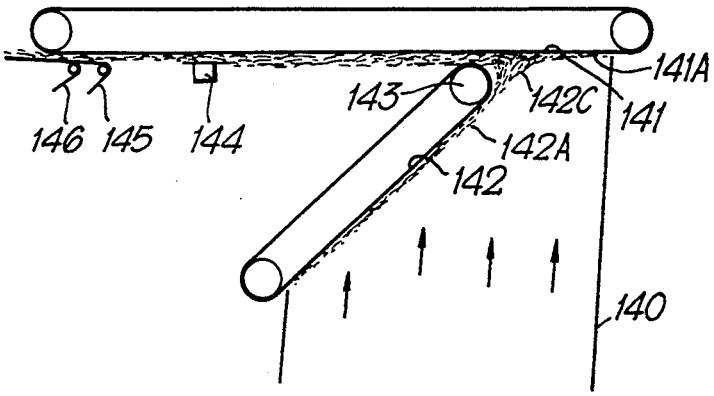
FIG. 3 is a front view of a different machine.

FIG. 3 shows an alternative machine involving the use of two suction bands for forming two sub-streams (not necessarily identical in weight per unit length) which are merged on one of the suction bands which then conveys the merged stream (preferably after trimming) to a rod-forming device in which it is enclosed in a wrapper web.

As shown in FIG. 3, tobacco is showered pneumatically up a shower channel 140 towards suction bands 141 and 142. The pronounced inclination of the band 142 to the horizontal will result in a sub-stream 142A forming on the band 142 having tobacco particles of somewhat random orientation, whereas the particles arriving on the band 141, forming sub-stream 141A, will tend more to be aligned to the band. A trimming device 144 is arranged to trim the merged filler stream before it is deposited on a wrapper web 145 carried by a garniture tape 146 by which, with the aid of a conventional tongue, the merged tobacco stream is further compressed and is shaped to the cross-section of a finished cigarette.

If desired, suction holding the sub-stream 142A on the band 142 may terminate in the region of the downstream pulley 143 so that the tobacco of sub-stream 142A can fly off the band under centrifugal force (as shown by the spray 142C) and be reorientated to some extent before arriving on the band 141.

As a modification of FIG. 3, the channel 140 may be inclined to the vertical so as to deliver a tobacco shower substantially at right angles to the band 142. The band 141 will then have a significant forward component with respect to tobacco arriving on it.

Figure 4:
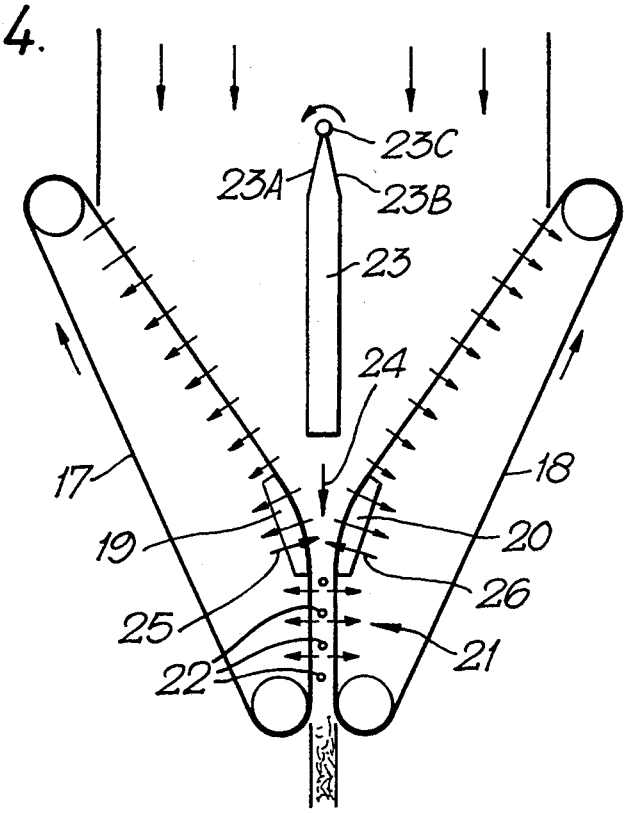
FIG. 4 is a plan view of another machine.

FIG. 4 illustrates diagrammatically a different machine having two converging bands 17 and 18 arranged to move initially along a linear path, and then along a curved path defined by a fixed guide 19 or 20. Further direction changes of the bands are achieved by pulleys as shown. Suction is applied through the bands, as indicated by the flow arrows, and in this connection it is particularly important to note that suction continues to be applied in the region 21 where the bands are moving along substantially parallel paths and act to compress and shape the merged tobacco stream. In that region the drawing also illustrates the provision of openings 22 which admit air streams vertically into the space between the bands, thus limiting or controlling the induction of an air flow in the direction of the parallel-moving portions of the bands, as shown by the arrow 24. The flow of air through the inlets 20 may be adjustable so as to vary the strength of the axial air flow 24 and thus vary the degree of longitudinal compacting of the merged tobacco stream produced by the air flow 24.

Figure 5:
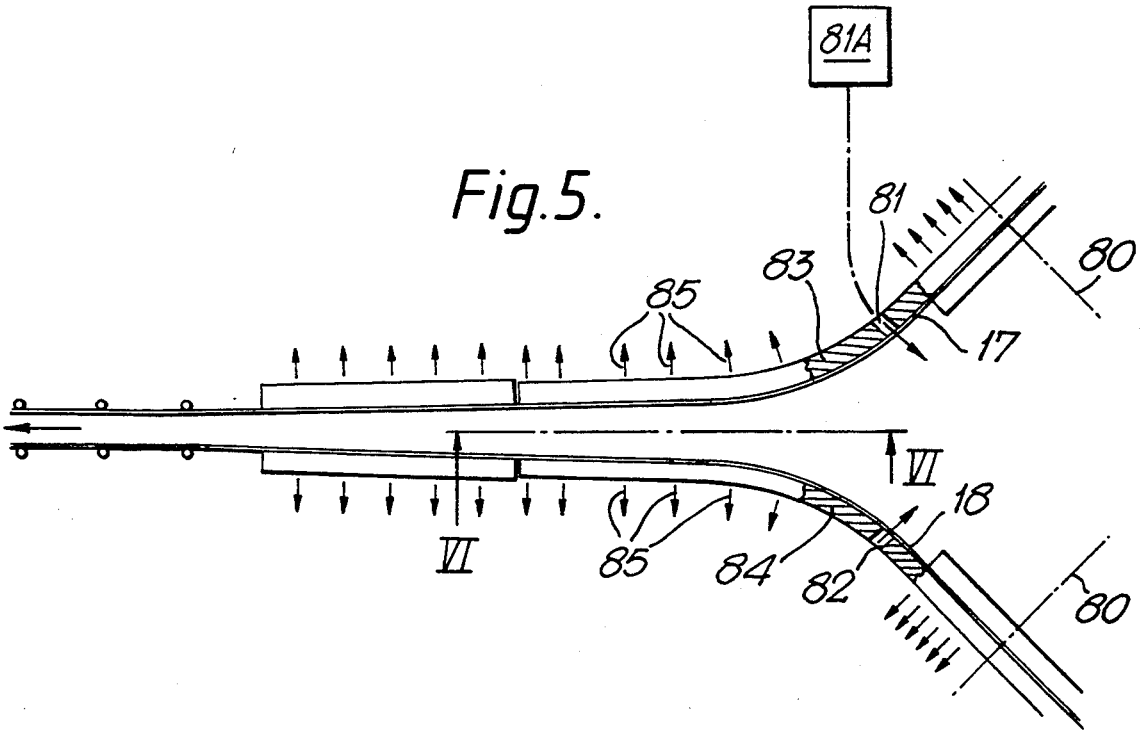
FIG. 5 is an enlarged view of part of a machine such as that shown in FIG. 4.

In addition, air may be blown outwards through the bands 17 and 18 (arrows 25 and 26) so as to tend to blow each tobacco sub-stream off its respective band, thus allowing or promoting a degree of re-orientation of the tobacco strands just before the two tobacco sub-streams merge; this feature is illustrated more clearly in FIG. 5, which is an enlargement of part of FIG. 4 in the region of the merger zone for the two tobacco sub-streams. Instead of the tobacco sub-streams on the bands 17 and 18 being disturbed by air jets (at arrows 25 and 26), they may be disturbed simply by reducing or releasing the suction applied to them as they pass around the curved guides 19, 20 so that they are disturbed by centrifugal force, by being partly or entirely flung off the bands, or so as simply to be able to expand.

FIG. 4 also illustrates an arrangement for splitting the showered tobacco stream in the middle to form two portions which arrive on the respective bands 17 and 18. Specifically, the tobacco stream is split by a divider 23 having diverging surfaces 23A and 23B extending from a small-diameter roller 23C which rotates in the direction of the arrow and ensures that tobacco arriving on the roller is not caught on the divider 23, but instead passes to the left so as to slide along the surface 23A. In the example shown, the angle between the surfaces 23A and 23B is 20°, but this angle may be reduced or possibly increased.

The divider 23 may be replaced by two diverging walls (effectively extended forms of the surfaces 23A, 23B) extending to positions close to the bands 17 and 18 and forming between them a space free from showered tobacco. That space may contain trimming devices for the two tobacco sub-streams on the bands 17, 18, as shown in FIG. 5.

FIG. 5 shows the bands 17 and 18 of FIG. 4 as they approach the merger area for the two tobacco sub-streams on the bands 17 and 18. Each of the sub-streams is trimmed by a trimming device centered on one of the axes 80. Each of these trimming devices may be substantially in the form shown in FIGS. 4 to 6 of our U.S. Pat. No. 4,276,891.

After trimming, at least part of each sub-stream is blown off its carrier conveyor band by air blown through apertures 81 and 82 in guide plates 83 and 84 respectively. In the area where the merged tobacco stream is progressively compressed by the bands, suction continues to be applied through the bands, as shown by arrows 85. Below the merged tobacco stream there is a wall 86 (see FIG. 6), and above the tobacco stream there is wall 87 formed with air inlet openings 88 which lie at regular intervals and are inclined so that the air flowing in through the openings 88 has a component of motion in the direction of motion of the tobacco. Beyond the upper wall 87 there is a continuation wall 89 which is likewise formed with inlet openings 89A inclined, in this case, at a greater angle to the vertical The air streams emitted through the apertures 81 and 82 serve to blow the tobacco off the bands 17 and 18, thus permitting at least some of the tobacco strands to become reorientated and to interengage or mix with strands of the other stream before the two sub-streams merge in the region where the bands continue in substantially parallel directions.

Each of the air inlet apertures 81 and 82 may extend across the whole width of the tobacco sub-stream, so as to disturb and re-orientate all the tobacco. Alternatively, each of the apertures may extend across only part of the width of the corresponding sub-stream: for example, the upper part of one and the lower part of the other. Another possibly is that one aperture may be in two parts acting on the side portions of the corresponding sub-stream, which the other may act on only the middle portion of the other sub-stream.

FIG. 5 also illustrates the provision of a control device 81A for controlling the supply of air to the aperture 81; the same control device or a separate one may similarly control the supply of air to the aperture 82. The control device 81A may comprise an electrically or mechanically controlled valve or other flow-control means whereby the flow of air is stopped or reduced while cigarette end portions of the tobacco streams are passing the apertures 81 and 83. This feature may be applied to other examples described in this specification, and particularly to FIGS. 1 and 2, to ensure or help to ensure that generally longitudinally orientated strands of tobacco at the cigarette end portions tend to remain in that orientation.

Instead of two entirely separate trimming devices being used to trim the two sub-streams as shown in FIG. 5, a common trimming device may be used as follows. The device would consist of a frusto-conical drum arranged with its axis in alignment with the central axis of the merged tobacco stream, and with blades on the frusto-conical surface which, in cooperation with stationary blades, would shear off excess tobacco from each of the sub-streams, substantially in the manner of the trimmer described in our above-identified U.S. patent. The stationary blades for this purpose may lie obliquely across the respective sub-streams. Movement of the entire device (including the drum and the blades) in the direction of the axis of the drum would vary the amount of tobacco removed from both sub-streams. Alternatively, the device may comprise a rotary member having an axis of rotation transverse to the central axis of the merged tobacco stream, and two frusto-conical bladed portions cooperating with stationary blades for trimming the respective sub-streams.

Figure 7:
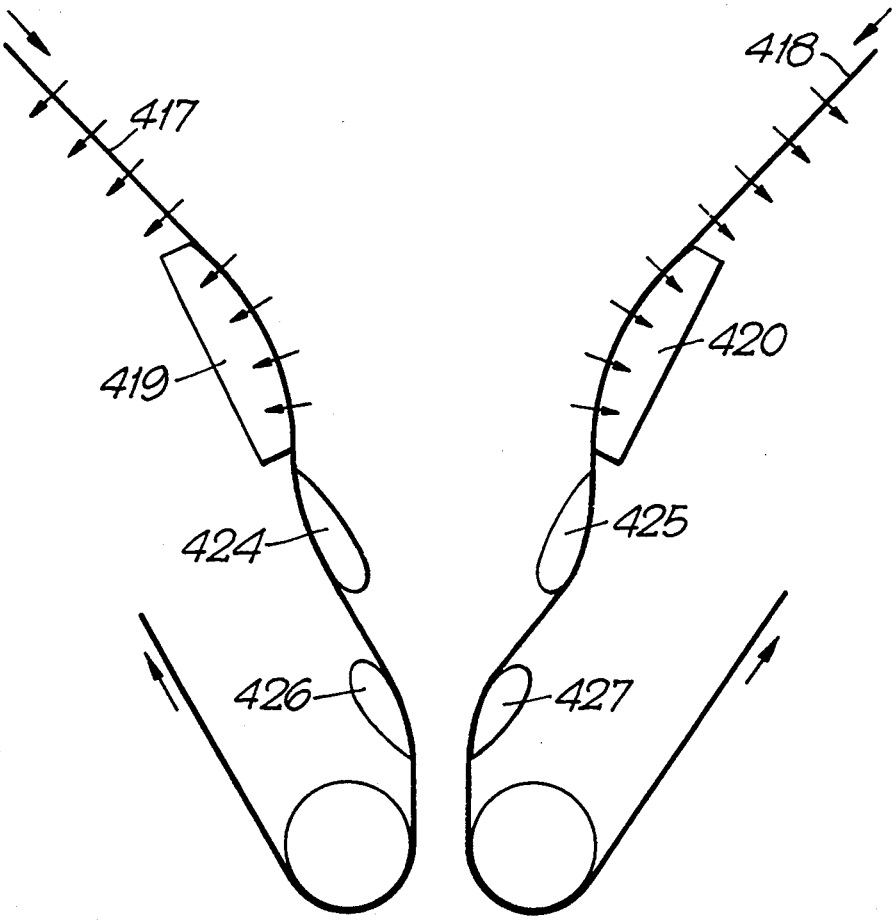
FIG. 7 is plan view of a different machine.
Figure 8:
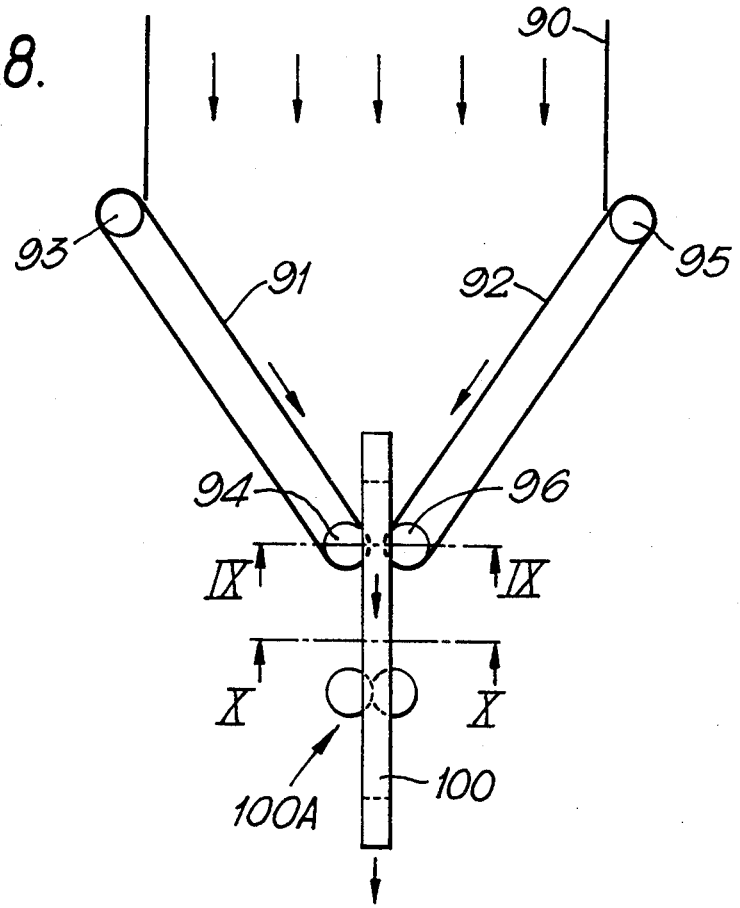
FIG. 8 is a plan view illustrating a machine in which the merged sub-streams are conveyed further by a third suction band.
Figure 9:
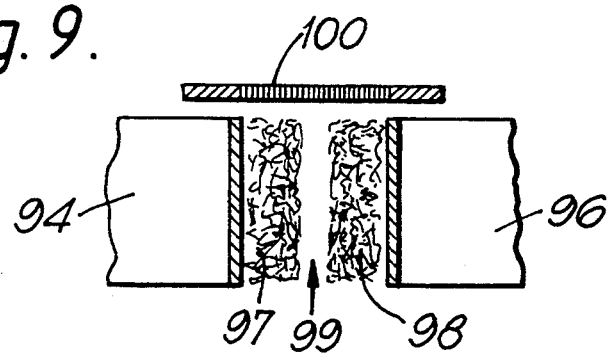
FIG. 9 is a section on the line IX—IX in FIG. 8.
Figure 10:
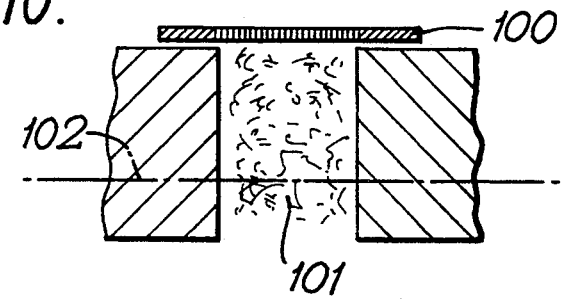
FIG. 10 is a section on the line X—X in FIG. 8.

FIG. 7 shows diagrammatically, on a larger scale, a modification of part of the machine shown in FIG. 4. After passing around fixed guides 419 and 420, the bands 417 and 418 pass around scraper guides 424 and 425 each of which serves to scrape tobacco from the corresponding band and thus deflect the tobacco towards the tobacco on the other band. Thus, the tobacco particles are disturbed and re-orientated in accordance with the main aspect of this invention and are more loosely conveyed by the bands after the bands pass around the guides 424, 425 and past additional fixed guides 426 and 427. This is particularly suitable for use in a machine in which the merged tobacco stream passes from the bands 417 and 418 and is carried further by a band above the merged stream in cooperation with a garniture tape below it; for example, as shown in FIGS. 8–10. Alternatively, the upper band may, for example, be a moulded (non-suction) band having a concave underneath surface so as to shape the tobacco stream, and this band may converge towards the garniture tape so as to compress the tobacco stream vertically.

Displacement of the tobacco from the bands 417 and 418 may be assisted (or achieved) by restricting the level of suction applied through the guides 419 and 420 so that the tobacco, or some of it, flies off under centrifugal force.

FIG. 8 is a diagrammatic plan view of part of a machine including a channel 90 through which tobacco is showered in a substantially horizontal direction towards two converging suction bands 91 and 92 passing around pulleys 93 to 96. As shown in FIG. 9, each of the tobacco sub-streams 97 and 98 formed on the respective bands 91 and 92 is relatively wide (vertically) but thin (horizontally), and the two sub-streams are slightly spaced apart at the downstream ends of the bands 91 and 92 (space 99 shown in FIG. 9).

A top suction band 100 receives the sub-streams 97 and 98 to form a merged stream 101 of more nearly square cross-section shown in FIG. 10, which is a cross-section immediately ahead of a trimming device 100A by which the merged stream is trimmed at approximately the level shown in FIG. 10 by the chain dotted line 102.

In separating from the bands 91 and 92 to form the merged tobacco stream 100, the tobacco of each of the sub-streams moves laterally upwards from the respective bands 91 and 92 and, in the process, is disturbed and is able to be reorientated at least to some extent, thus improving the filling power of the tobacco in the finished cigarette. In effect, this may be seen in terms of the each of the sub-streams and 98 folding into one another in passing to the overhead suction band 100.

After trimming, the cigarette filler stream 100 is deposited on a cigarette wrapper web carried by a conventional garniture tape (not shown).

Figure 11:
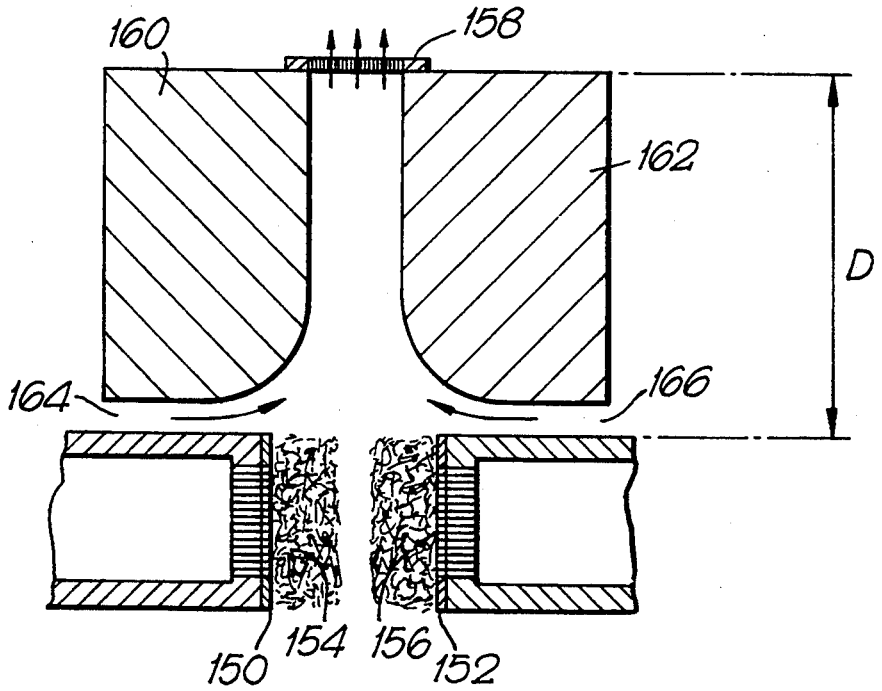
FIG. 11 is a cross-sectional view similar to FIG. 9 but showing a modified machine.

FIG. 11 shows a modification of the example shown in FIGS. 8 to 10, being a cross-section corresponding to FIG. 9. In this case, bands 150 and 152 carrying tobacco sub-streams 154 and 156 are vertically spaced from a suction band 158 to which the tobacco passes via a short chimney defined by rails 160 and 162. Air sucking the tobacco upwards for this purpose results from suction applied above the band 158, and there are also air inlets 164 and 166. As an idea of scale, the distance D through which tobacco moves to reach the band 158 may be approximately 25 mm.

Figure 12:
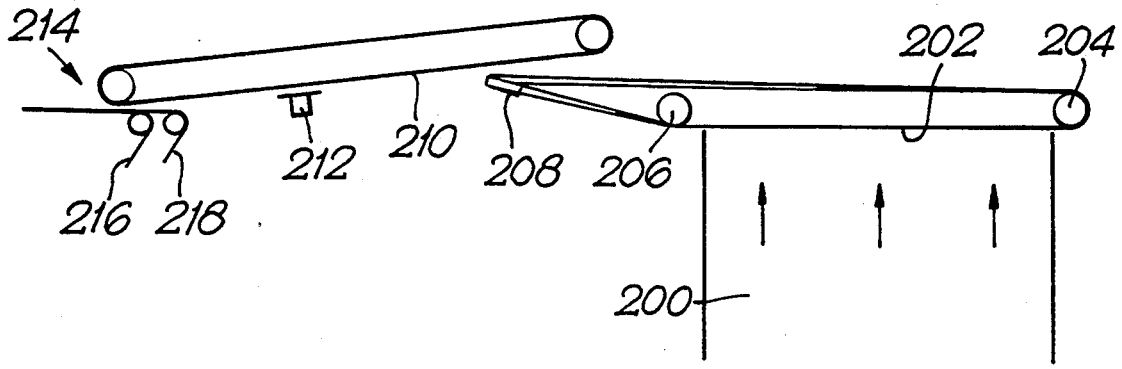
FIG. 12 is a front view of another machine.

FIG. 12 illustrates another modification of FIG. 8. In this example, tobacco is showered vertically upwards through two parallel shower channels 200 (only the nearer channel being visible) towards two parallel suction bands 202 each of which passes around three pulleys 204, 206 and 208. In passing from the pulley 206 to the pulley 208, each band is twisted through 90°, the two pulleys 208 being angularly displaced in opposite directions. Thus the two suction bands present two sub-streams to a further suction band 210 in substantially the manner shown in FIG. 9 or FIG. 11. The band 210 carries a merged tobacco stream past a trimming device 212 and into a conventional garniture 214 including a garniture tape 216 carrying a wrapper web 218.

Figure 13:
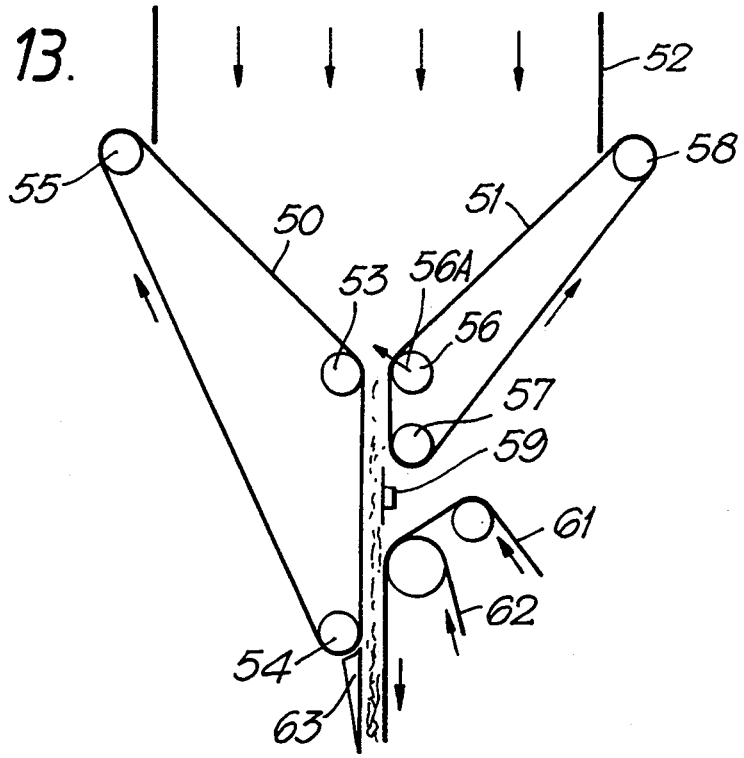
FIGS. 13 and 14 are plan views of two other machines.

FIG. 13 is a diagrammatic plan view of another form of machine according to this invention in which two converging suction bands 50 and 51, passing around pulleys 53 to 58, receive tobacco showered through a horizontal shower channel 52. The band 50 continues beyond the pulley 57 for the band 51, and carries the merged tobacco stream past trimmer disks 59 (of conventional construction) arranged vertically. The trimmed tobacco stream 60 is then brought into engagement with a wrapper web 61 conveyed by a garniture tape 62 which becomes progressively concave in cross-section to shape the tobacco stream. Shaping of the tobacco stream on the side opposite to the garniture tape may be achieved partially by the band 50, but is completed by a tongue 63 which also compresses the tobacco stream to the final cross section at which the wrapper web 61 can be wrapped around the tobacco stream in the usual manner.

Alternatively, after leaving the pulley 53, the band 50 may be twisted through 90° so as to carry the merged tobacco stream below it and thus be able to deposit the tobacco stream on a conventionally orientated garniture tape. The trimmer discs 59 will in this case be appropriately orientated so as to be parallel to the adjacent portion of the band 50.

An air jet 56A may be directed through the band 51 to disturb the tobacco on the band 51 before it is merged with the tobacco on the band 50.

Figure 14:
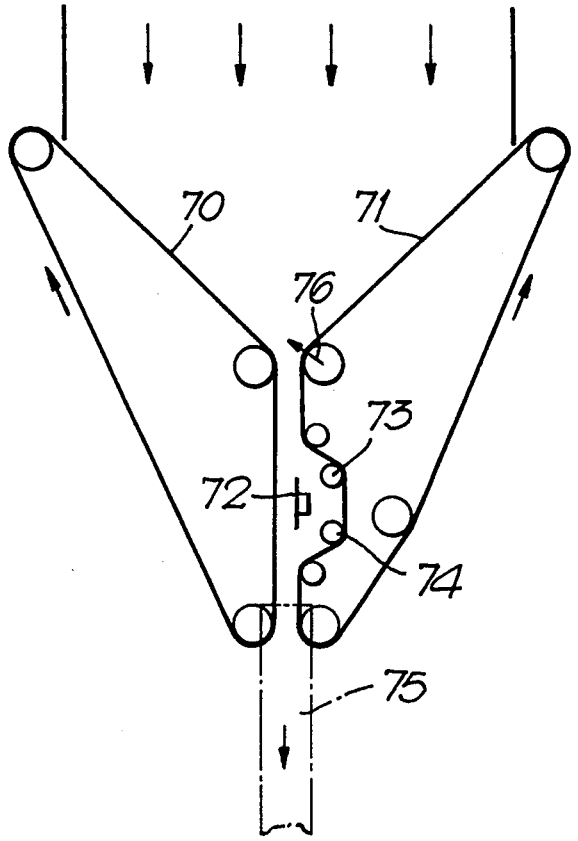

FIG. 14 shows a different construction in which, as before, tobacco sub-streams are formed on two suction bands 70 and 71. The difference is that the band 71, after the tobacco sub-streams have been merged and are being carried by the band 70, is deflected around a pair of trimmer disks 72 by pulleys 73 and 74, and then assists in the further conveyance of the merged tobacco stream until the merged stream is engaged between an upper band 75 and a garniture tape below it. As described above, the upper band 75 may be of moulded form presenting a concave underneath surface for shaping the tobacco stream, and may converge towards the garniture tape. Thus the upper band in effect serves as a "moving shoe". An air jet 76 may be provided to serve the same purpose as the air jet 56A in FIG. 13.

Figure 15:
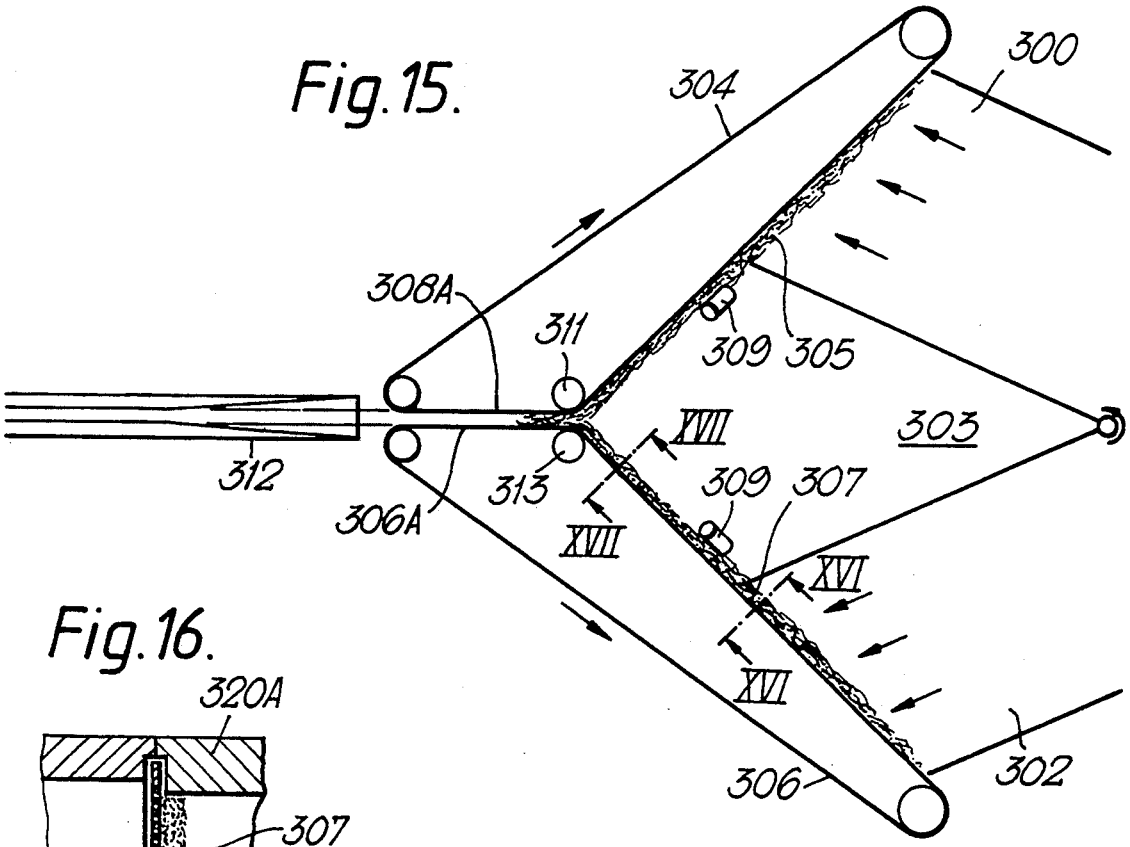
FIG. 15 is a plan view of yet another machine including, like FIG. 8, a third suction band for receiving the merged sub-streams.

FIG. 15 is a plan view of another machine having some similarities to the example shown in FIGS. 8 to 10. In this example, tobacco is showered through two separate diverging horizontal channels 300 and 302 towards two suction bands 304 and 306 respectively to form tobacco sub-streams 305 and 307. After emerging from the shower channels 300, 302, the tobacco sub-streams on the two bands are trimmed by trimming devices 309 each of which may be as described in our above-mentioned U.S. Pat. No. 4,276,891. Both trimmed sub-streams are then received by a top suction band 310 shown on its own in FIG. 18 without, for the purpose of simplification, the suction bands 304 and 306. However, it should be noted that substantially parallel runs 306A and 308A of the bands continue to confine the sides of the merged tobacco stream until shortly before the merged stream is deposited on a continuous wrapper web 312 carried by a garniture tape 314, and the suction band 310 then continues and may further compress and shape the cigarette filler stream until it reaches a pulley 316 following which a fixed tongue 318 completes the compression and shaping of the filler stream.

A pulley 319 for the band 310 has its axis in a vertical plane containing the axes of pulleys 311 and 313 for the bands 304 and 306.

In order to shape the top of the merged filler stream while it is being conveyed and compressed between the top band 310 and the garniture tape 314, the following may apply. Top guides (not shown) for the active run of the band 310, for example rollers or fixed guides, may be shaped so as to allow the band, after it passes the bands 304, 306, to assume a progressively concave cross-section so as to shape the top surface of the merged filler stream. At this stage the band 310 may pass between fixed side rails (not shown) confining the sides of the tobacco stream until the garniture tape has become sufficiently trough-like to serve that purpose. The pulley 316 has a corresponding concave peripheral cross-section to match that of the band 310 at that point. As it passes over the fixed tongue 318 (which also serves as a "shoe" for scraping the tobacco stream off the band 310) the tape is allowed progressively to assume a flatter cross-section; it may be flat, or may possibly curve the other way, as it passes around a fixed pulley 321.

The divergence of the slower channels 300 and 302 (as shown in FIG. 15) leaves a space 303 which may accommodate means for adding dense ending extra quantities of tobacco into the merged filler stream, for example as described in our above mentioned U.S. Pat. No. 5,141,003, and/or for injecting, between the sub-streams 305, 307 as or immediately before they merge, a continuous or intermittent stream of liquid or foam containing adhesive and/or tobacco-flavouring material. Another possibility is that a stream of tobacco or other material, or a pre-formed continuous rod or string, may be introduced between the sub-streams 305, 307 so as to form a core in the finished cigarette rod, which core is substantially surrounded by the tobacco of the sub-streams 305, 307; for this purpose each of the substreams may, as it collapses from the high/narrow cross-section shown in FIG. 17, be induced by the application of increased suction at the sides of the band 304, 306 to form a concave outer cross-section with a greater thickness of tobacco at the sides than at the middle.

Figure 16:
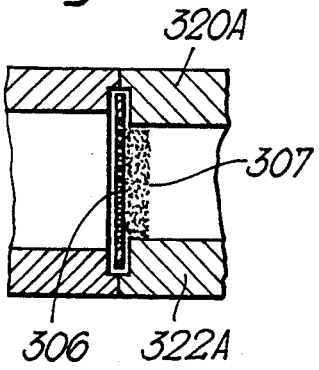
FIG. 16 is a section on the line XVI—XVI in FIG. 15.

FIG. 16 shows the cross sectional shape of the tobacco sub-stream 307 on the suction band 306; the same applies to the sub-stream 305 on the band 304. The sides of the sub-stream are confined by rails 320 and 322 defining a relatively narrow gap (approximately 5 mm) so that the filler stream has a substantial height (approximately 9 to 10 mm). In the region of the trimmer, the rails are cut away (to about the line 324) to allow the trimmer to remove tobacco projecting beyond a predetermined distance from the band.

Figure 17:
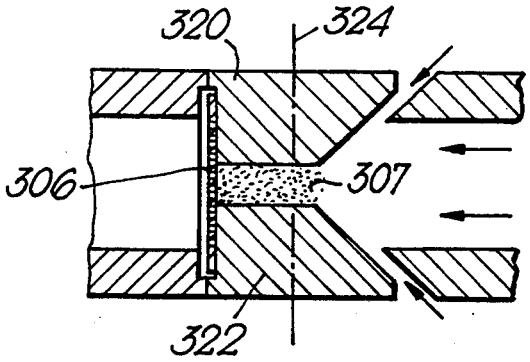
FIG. 17 is a section on the line XVII—XVI in FIG. 15.
Figure 18:
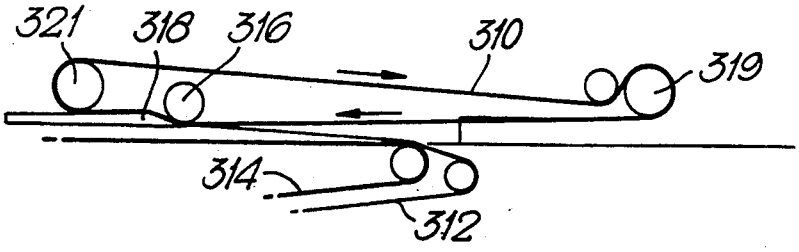
FIG. 18 shows a top suction band arranged to receive the merged sub-streams from the apparatus shown in FIG. 15.

Immediately after trimming, extensions 320A and 322A of the rails 320 and 322 change in cross-section (either abruptly or progressively) to the cross-section shown in FIG. 17. This allows the trimmed sub-stream to become flatter, so that the two sub-streams and the top suction band which receive them appear similar to FIG. 9.

Instead of the rails 320 and 322 being shaped so as to permit the trimmed sub-stream to collapse symmetrically after trimming, they may be arranged to allow or guide the trimmed sub-stream to fold over towards one side. For that purpose the rails 322, 324 would be asymetrical so as to form the narrow/high substreams along or near one side edge of the band 304, 306, one being possibly near the upper edge of its band and the other near the lower edge so that they fold over downwards and upwards respectively to form approximately the wide/low cross-section shown in FIG. 16.

Any of the above-described methods of reforming each of the sub-streams before merging may be used in a machine without the top band 310, for example as basically described in our above-mentioned U.S. Pat No. 5,199,446.

Figure 6:
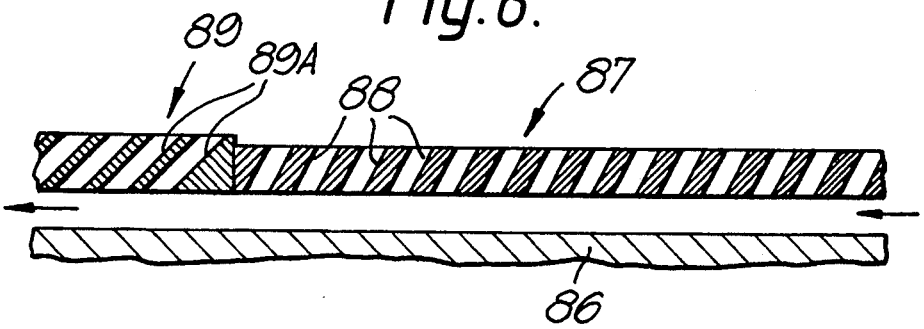
FIG. 6 is a sectional view on the line VI—VI in FIG. 5.

As described with reference to FIGS. 4 to 6, there may be provision for introducing air vertically into the space between the parallel runs 306A and 308A of the bands 306 and 308 to control the degree to which suction applied through the bands 306 and 308 and also through the top band 310 induces an axial air flow into the space between the band runs 306A and 308A. The air inlets in this case are preferably formed in a fixed bottom wall corresponding to the wall 86 in FIG. 6.

In order to form denser end portions in the finished cigarettes, spaced mounds of additional tobacco may be fed onto the top suction band 31 0 (e.g. by a pocketed wheel) before it receives the two sub-streams from the bands 304 and 306.

Instead of each of the bands 304 and 306 being flat in cross-section where it receives the showered tobacco, each may be curved or may become progressively curved so as to present a concave upper surface (in cross-section) to receive the showered tobacco and thereby form a relatively narrow tobacco stream 307 of which the sides are confined partly by the side portions of the band. Suction may be applied to those side portions so as to grip the tobacco there as well as at the centre of the band corresponding to the bottom of the concave. After trimming, each of the bands is progressively flattened so as to arrive at the pulleys 311, 313 in the condition shown approximately in FIG. 16. During this flattening process the trimmed filler stream 307 divides approximately through the middle to form an approximately even low-height wide stream as shown in FIG. 16 in preparation for the merging of the two sub-streams as already described.

The curving of the bands in this manner may be controlled by support rollers having the appropriate straight or concave peripheries as viewed in longitudinal section. The suction which draws the tobacco onto the bands also pulls the bands onto the rollers; however, to ensure that the bands do curve in cross-section in the described manner, the path of each band may be slightly curved in the sense shown in Figure 1, but with a larger radius of curvature, so that tension in the bands assists their cross-sectional curving.

We claim:

1. A method of making cigarettes, in which tobacco is showered onto two suction bands to form two tobacco sub-streams which are then merged to form a single cigarette filler stream of which at least portion is enclosed in a continuous wrapper web to form a continuous cigarette rod, characterised in that at least part of the tobacco on at least one of the tobacco sub-streams is disturbed before the two sub-streams are merged, so as to cause or permit a degree of reorientation of the disturbed tobacco and a degree of interengagement between tobacco particles of the two sub-streams.

2. A method according to claim 1, in which both tobacco sub-streams are disturbed by pneumatic or mechanical means displacing at least part of the tobacco of each sub stream from its corresponding suction band at a position upstream of the position at which the two sub-streams are merged to form the cigarette filler stream.

3. A method according to claim 1, in which the disturbance of the tobacco occurs while the tobacco of at least one of the sub-streams is transferred from its initial carrier band to another band which carries the merged sub-streams towards the location at which the thus-formed cigarette filler stream is enclosed in a wrapper web to form a continuous cigarette rod.

4. A cigarette making machine comprising means for showering tobacco towards two suction bands to form tobacco sub-streams on the respective bands which are then merged to from a single cigarette filler stream, and including means for enclosing at least a portion of the filler stream in a wrapper web to form a continuous cigarette rod, and means for disturbing at least part of the tobacco of at least one of the tobacco sub-streams before the two sub-streams are merged.

5. A machine according to claim 4 in which both tobacco sub-streams are disturbed by being drawn from their respective suction bands by air streams transferring the sub-streams onto a further suction band which is arranged to carry the thus-formed filler stream towards a rod-forming section of the machine.

6. A machine according to claim 4 in which both tobacco sub-streams are disturbed by one or more air jets which displace at least part of the tobacco of each sub-stream from the corresponding suction band.

7. A machine according to claim 4 including, adjacent to each of the suction bands carrying the tobacco sub-streams, rails positioned so that each sub-stream is formed initially as an approximately rectangular cross-section having a relatively narrow width measured parallel to the suction band and a larger cross-sectional dimension extending in a direction away from the suction band, and including means for trimming each sub-stream while it has the relatively narrow width defined by the rails.

8. A machine according to claim 7 in which extensions of the rails beyond the trimming positions are spaced further apart to allow each sub-stream to adopt a wider, less high cross-section prior to the sub-streams being merged.

9. A machine according to claim 4, in which at least one of the sub-streams is disturbed pneumatically by an air jet controlled by a control device whereby the air jet causes the disturbance, or an increased disturbance, to occur in regions of the sub-stream lying between the end portions of the final cigarettes.

10. A machine according to claim 4, including means for delivering additional amounts of tobacco to areas of the cigarette filler stream corresponding to cigarette end portions.

11. A machine according to claim 4, in which disturbance of each of the sub-streams is arranged to be caused or assisted by centrifugal force.

12. A cigarette making machine comprising means for showering tobacco towards and onto tobacco shower receiving surfaces of two moving suction bands to form tobacco sub-streams on the respective bands which are then merged to form a single cigarette filler, and including means for enclosing at least a portion of the filler streams in a wrapper web to form a continuous cigarette rod, at least one portion of the tobacco shower receiving surface of at least one of the suction bands having little or no forward component of movement with respect to the direction of movement of the showered tobacco arriving on it, and at least one portion of the tobacco shower receiving surface of at least one band having a significant forward component of movement with respect to the direction of movement of the showered tobacco arriving on it.

13. A machine according to claim 12, in which at least a portion of the tobacco shower receiving surface of each of the suction bands is arranged to move along a curved path.

14. A machine according to claim 12, in which one of the suction bands is inclined to the direction of movement of the showered tobacco so as to have a significant forward component, while the second band has little or no forward component with respect to the showered tobacco.

15. A machine according to claim 14, in which the second of the suction bands is arranged to receive the sub-stream formed on the first band, and to carry the thus-formed cigarette filler stream to a rod-forming part of the machine.

16. A machine according to claim 15, in which the cigarette filler stream, while being carried by the second band, is subjected to trimming by a trimming device before it arrives at the rod-forming section.

17. A cigarette making machine comprising means for showering tobacco towards two suction bands to form tobacco sub-streams on the respective bands which are then merged to form a single cigarette filler stream, and including means for enclosing at least a portion of the filler stream in a wrapper web to form a continuous cigarette rod, the two suction bands being adapted to compress and/or shape the cigarette filler stream formed by merging the two sub-streams, and suction being applied through the bands while they are compressing and/or shaping the cigarette filler stream, thus including an axial air flow parallel to the direction of movement of the cigarette filler stream.

18. A machine according to claim 17, in which air is admitted through openings formed in a fixed top or bottom wall to limit or control the axial air flow.

19. A cigarette making machine comprising means for showering tobacco towards two suction bands to form tobacco sub-streams on the respective bands which are then merged to form a single cigarette filler stream, and including means for enclosing at least a portion of the filler stream in a wrapper web to form a continuous cigarette rod, one of the suction bands being arranged to receive the sub-stream formed on the second suction band and to convey the merged streams past a trimming device and then to a rod-forming section of the machine.

* * * * *